US008235684B2

(12) United States Patent
Song et al.

(10) Patent No.: US 8,235,684 B2
(45) Date of Patent: Aug. 7, 2012

(54) AIR PUMP CAPABLE OF INFLATING AND DEFLATING AN INFLATABLE PRODUCT

(76) Inventors: Rong-Jyh Song, Taipei (TW); Tsung-Ping Yen, Taipei (TW)

( * ) Notice: Subject to any disclaimer, the term of this patent is extended or adjusted under 35 U.S.C. 154(b) by 243 days.

(21) Appl. No.: 12/802,322

(22) Filed: Jun. 4, 2010

(65) Prior Publication Data

US 2011/0180169 A1 Jul. 28, 2011

(30) Foreign Application Priority Data

Jan. 26, 2010 (CN) ..... 2010 2 0102436 U

(51) Int. Cl.
*F04D 29/00* (2006.01)
*A47C 27/08* (2006.01)

(52) U.S. Cl. ..... 417/315; 5/713; 417/423.14

(58) Field of Classification Search ..... 417/239, 417/315, 423.14, 321; 5/708, 713
See application file for complete search history.

(56) References Cited

U.S. PATENT DOCUMENTS

| | | | | |
|---|---|---|---|---|
| 6,287,095 | B1 * | 9/2001 | Saputo et al. | 417/472 |
| 6,709,246 | B2 * | 3/2004 | Boyd | 417/423.1 |
| 7,040,347 | B2 * | 5/2006 | Wang | 137/625.22 |
| 7,114,207 | B2 * | 10/2006 | Wang | 5/713 |
| 7,128,525 | B2 * | 10/2006 | Tsai | 415/128 |
| 7,198,076 | B2 * | 4/2007 | Wu | 141/197 |
| 7,210,902 | B2 * | 5/2007 | Song et al. | 415/202 |
| 7,246,394 | B2 * | 7/2007 | Wang | 5/713 |
| 7,475,440 | B2 * | 1/2009 | Chaffee | 5/644 |
| 7,571,500 | B2 * | 8/2009 | Wu | 5/173 |
| 7,588,425 | B2 * | 9/2009 | Chung | 417/315 |
| 8,033,800 | B2 * | 10/2011 | Pan | 417/423.14 |
| 2005/0079077 | A1 * | 4/2005 | Tsai et al. | 417/423.15 |
| 2005/0129541 | A1 * | 6/2005 | Tsai | 417/423.15 |
| 2006/0085918 | A1 * | 4/2006 | Metzger | 5/713 |
| 2008/0087342 | A1 * | 4/2008 | Wang | 137/624.27 |
| 2010/0014993 | A1 * | 1/2010 | Wang et al. | 417/315 |
| 2010/0247337 | A1 * | 9/2010 | Tsai | 417/239 |
| 2010/0247356 | A1 * | 9/2010 | Tsai | 417/423.14 |
| 2011/0020149 | A1 * | 1/2011 | Tsai | 417/321 |
| 2011/0158834 | A1 * | 6/2011 | Pan | 417/423.14 |

* cited by examiner

*Primary Examiner* — Devon C Kramer
*Assistant Examiner* — Nathan Zollinger
(74) *Attorney, Agent, or Firm* — DLA Piper LLP (US)

(57) ABSTRACT

An air pump includes a sliding member disposed movably a housing and cooperating with the housing and a partition casing in the housing to define first and second chambers thereamong. The air pump is operable between a deflation state, where air from an inflatable product connected to an air nozzle on the housing into an air impeller chamber in the partition casing through the first chamber and an air inlet in the partition casing is driven by rotation of an air impeller to flow outside the air pump through an air outlet in the partition casing, the second chamber and an first vent unit in housing, and an inflation state, where air flowing from the outside into the air impeller chamber through a second vent unit in the sliding member, an air pipe of the sliding member and the air inlet is driven to flow into the inflatable product through the air outlet, the first chamber and the air nozzle.

10 Claims, 6 Drawing Sheets

AIR PUMP CAPABLE OF INFLATING AND DEFLATING AN INFLATABLE PRODUCT

CROSS-REFERENCE TO RELATED APPLICATION

This application claims priority of Chinese Application No. 201020102436.9, filed on Jan. 26, 2010.

BACKGROUND OF THE INVENTION

1. Field of the Invention

The invention relates to an air pump, and more particularly to an air pump capable of inflating and deflating an inflatable product.

2. Description of the Related Art

An inflatable product, such as an inflatable mattress, an inflatable chair, an inflatable boat, an inflatable toy, etc., is inflated during use, and is deflated during non-use, thereby minimizing the size thereof. A conventional air pump may be utilized to inflate the inflatable product. However, when the inflated product is required to deflate, the inflated product exhausts air slowly without external pressure on the inflated product, thereby wasting time during deflation. Therefore, it is desired to design an air pump capable of inflating and deflating an inflatable product.

SUMMARY OF THE INVENTION

Therefore, an object of the present invention is to provide an air pump that can be easily operated to inflate and deflate an inflatable product.

According to the present invention, an air pump comprises:

a hollow housing formed with an opening and a first vent unit, and provided with an air nozzle thereon, the air nozzle being adapted to be connected to an inflatable product;

a partition casing disposed fixedly in the housing, cooperating with the housing to define an air impeller chamber therebetween, and formed with an air inlet and an air outlet that are in spatial communication with the air impeller chamber;

a sliding member disposed movably in the housing and operable to move relative to the housing between an inflation position and a deflation position, the sliding member having an operating plate exposed partly from the housing via the opening and formed with a second vent unit, a partitioning plate connected to the operating plate, and an air pipe connected to the operating plate and the partitioning plate, in spatial communication with the second vent unit in the operating plate and having an open end, the partitioning plate of the sliding member cooperating with the housing and the partition casing to define thereamong a first chamber that receives the air pipe and is in spatial communication with the air nozzle, and a second chamber that is in spatial communication with the first vent unit in the housing;

a motor disposed in the second chamber and having a drive shaft extending into the air impeller chamber in the partition casing; and an air impeller disposed in the air impeller chamber in the partition casing, and coupled to the drive shaft of the motor such that the air impeller is driven by the motor to rotate.

When the sliding member is in the inflation position, the second vent unit in the operating plate of the sliding member is exposed from the housing via the opening, the air outlet in the partition casing is in spatial communication with the first chamber, and the open end of the air pipe of the sliding member is connected to the air inlet in the partition casing such that the air pipe of the sliding member is in spatial communication with the air impeller chamber in the partition casing.

When the sliding member is in the deflation position, the second vent unit in the operating plate of the sliding member is covered by the housing, the air outlet in the partition casing is in spatial communication with the second chamber, and the open end of the air pipe of the sliding member is spaced apart from the air inlet in the partition casing such that the air impeller chamber in the partition casing is in spatial communication with the first chamber via the air inlet.

The air pump is operable between an inflating mode, where the sliding member is moved to the inflation position such that air flowing from the outside into the air impeller chamber in the partition casing through the second vent unit in the operating plate of the sliding member, through the air pipe of the sliding member and through the air inlet in the partition casing is driven in response to rotation of the air impeller driven by the motor to flow into the inflatable product through the air outlet in the partition casing, through the first chamber and through the air nozzle, thereby injecting air into the inflatable product, and a deflating mode, where the sliding member is moved to the deflation position such that air flowing from the inflatable product into the air impeller chamber in the partition casing through the air nozzle, through the first chamber and through the air inlet in the partition casing is driven in response to rotation of the air impeller driven by the motor to flow outside through the air outlet in said partition casing, through the second chamber and through the first vent unit in the housing, thereby expelling the air from the inflatable product.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
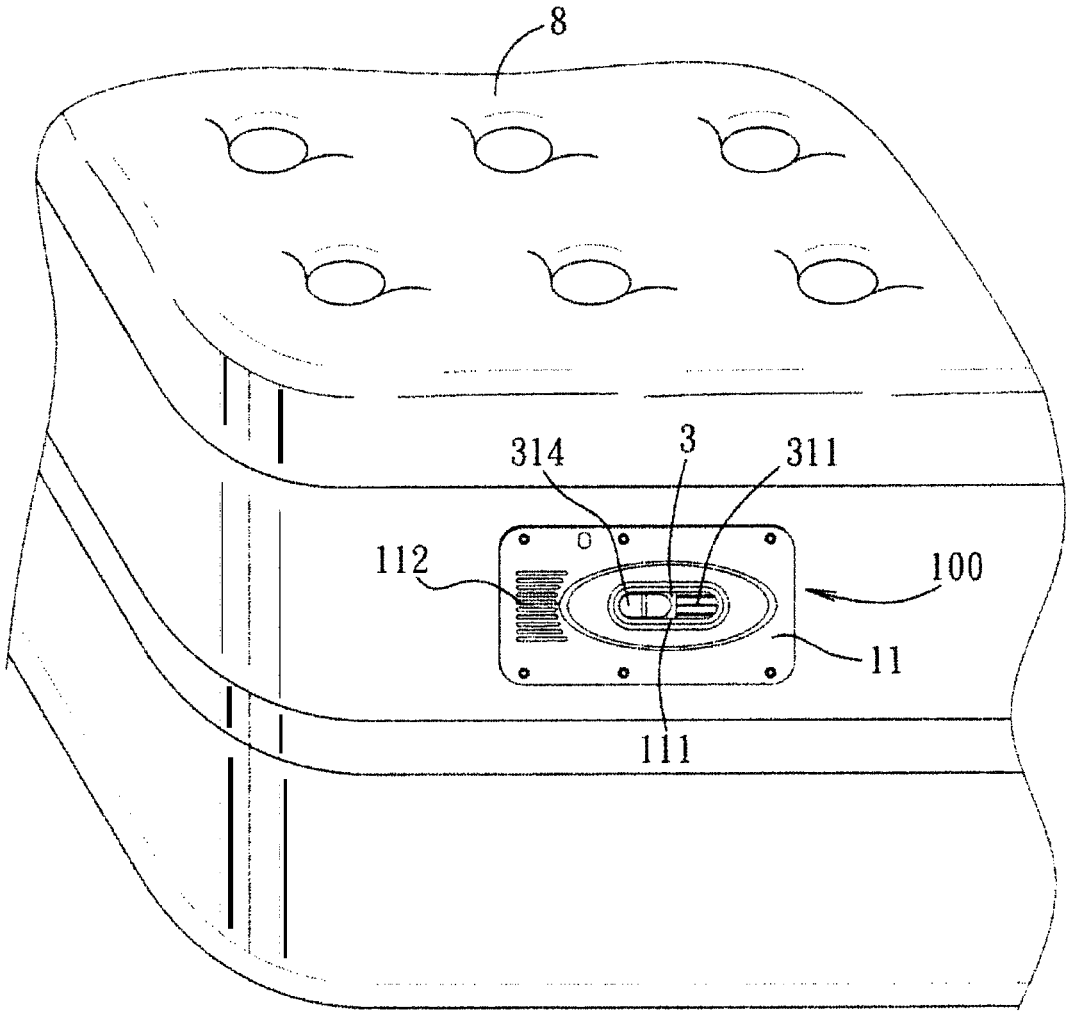
FIG. 1 is a fragmentary schematic view showing the preferred embodiment of an air pump according to the present invention when mounted to an inflatable product.

Referring to FIGS. 1 to 4 and 7, the preferred embodiment of an air pump 100 according to the present invention is shown to include a hollow housing 1, a partition casing 2, a sliding member 3, a motor 4, and an air impeller 5. The air pump 100 is capable of inflating and deflating an inflatable product 8, such as an inflatable mattress.

Figure 4:
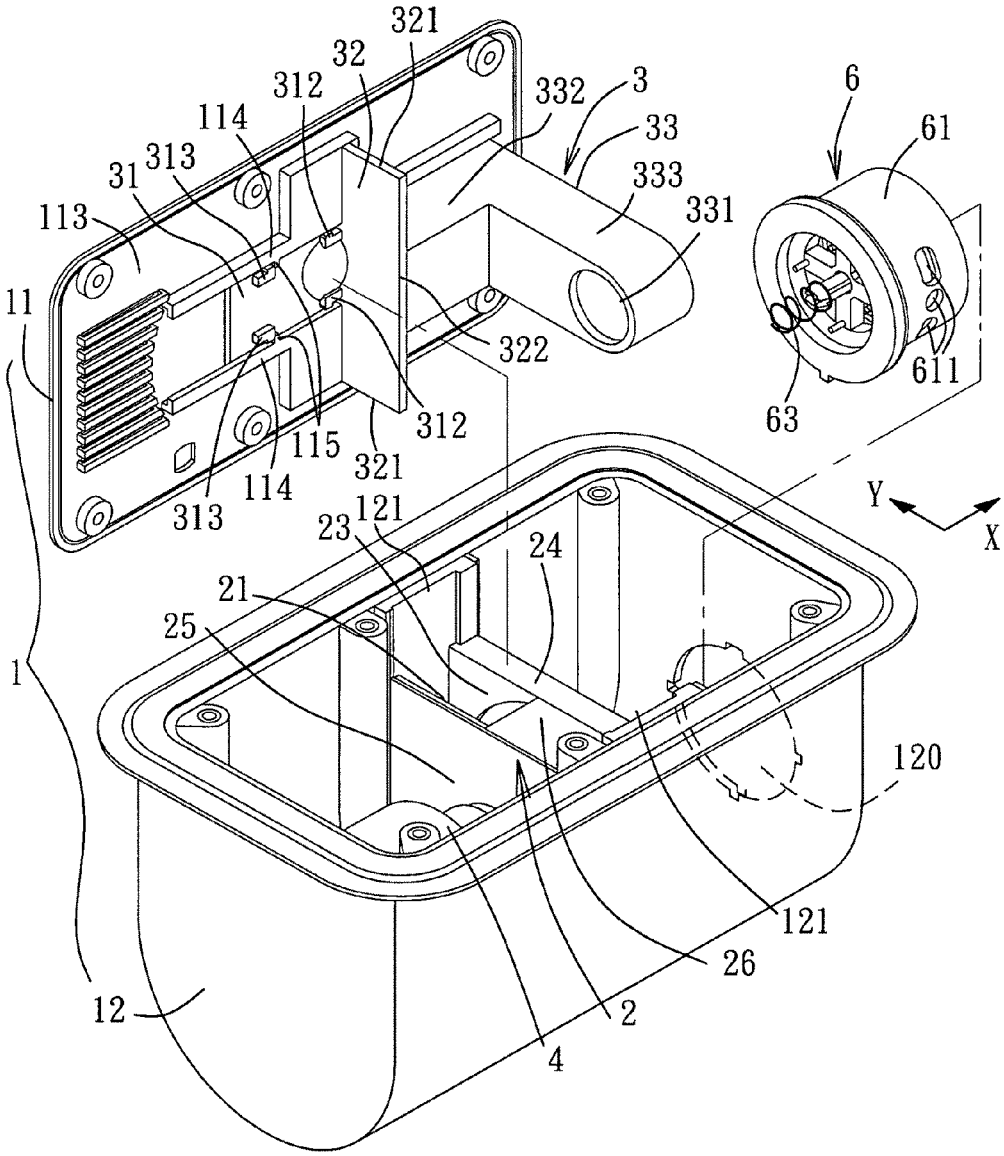
FIG. 4 is a partly exploded perspective view showing the preferred embodiment.
Figure 5:
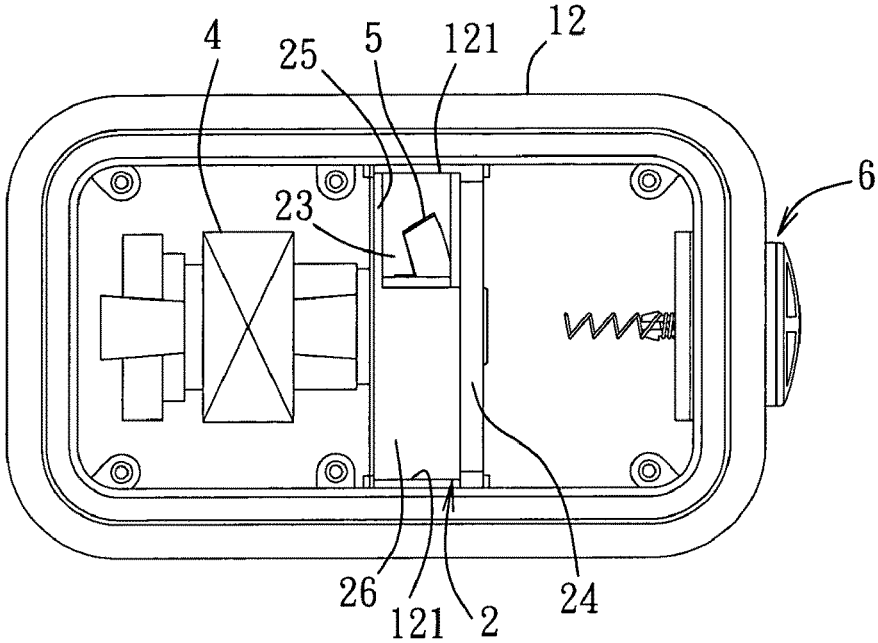
FIG. 5 is a schematic top view showing the preferred embodiment without a cap body.
Figure 6:
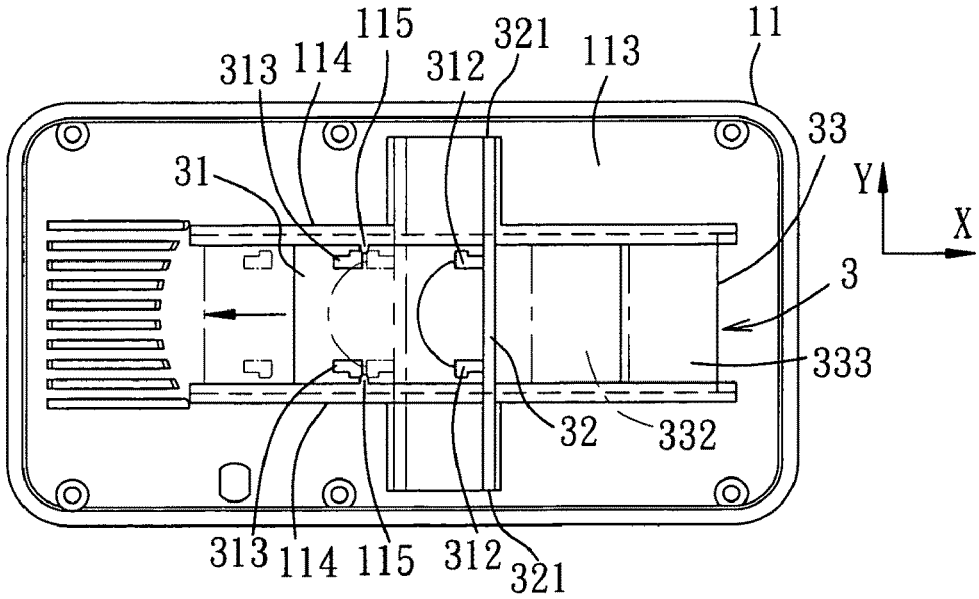
FIG. 6 is a schematic bottom view showing the cap body of the preferred embodiment.

The housing 1 is formed with an opening 111, and a first vent unit 112 that consists of a plurality of slots in this embodiment (see FIG. 2), and is provided with an air nozzle 6 thereon. The air nozzle 6 is adapted to be connected to the inflatable product 8. In this embodiment, the housing 1 has a base body 12, and a cap body 11 connected sealingly to the base body 12. The cap body 11 is formed with the opening 111 and the first vent unit 112. As shown in FIG. 6, the cap body 11 has an inner side surface 113, and two elongate guiding rails 114 formed on the inner side surface 113, extending in a first direction (X), and spaced apart from each other in a second direction (Y) transverse to the first direction (X) such that the opening 111 is disposed between the guiding rails 114. The cap body 11 is further formed with two stopping protrusions 115 extending respectively from the guiding rails 114 toward each other. The base body 12 is provided with the air nozzle 6 thereon. In this embodiment, as shown in FIG. 4, the base body 12 is formed with a mounting hole 120 for mounting the air nozzle 6 therein, and has an inner surface that includes two inner side surface portions opposite to each other in the second direction (Y), each of which is formed with a positioning groove 121.

Figure 7:
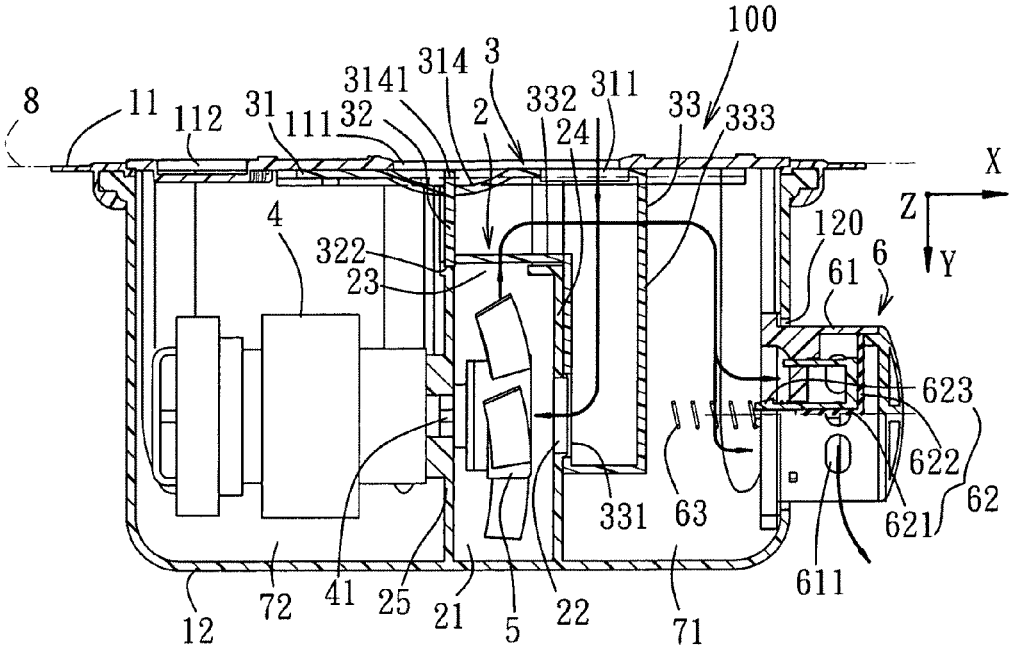
FIG. 7 is a partly schematic sectional view of the preferred embodiment taken along line VII-VII in FIG. 2.

Referring further to FIG. 7, the partition casing 2 is disposed fixedly in the housing 1, cooperates with the housing 1 to define an air impeller chamber 21 therebetween, and is formed with an air inlet 22 and an air outlet 23 that are in spatial communication with the air impeller chamber 21. In this embodiment, the partition casing 2 includes opposite first and second walls 24, 25 spaced apart from each other in the first direction (X) and connected to the inner surface of the base body 11 of the housing 1, and a third wall 26 spaced apart from the cap body 11 of the housing 1, connected among the first and second walls 24, 25 and the inner surface of the base body 11 of the housing 1, and formed with the air outlet 23. The first wall 24 is formed with the air inlet 22.

The sliding member 3 is disposed movably in the housing 1, and is operable to move relative to the housing 1 between an inflation position and a deflation position. The sliding member 3 has an operating plate 31, a partitioning plate 32 and an air pipe 33.

Figure 2:
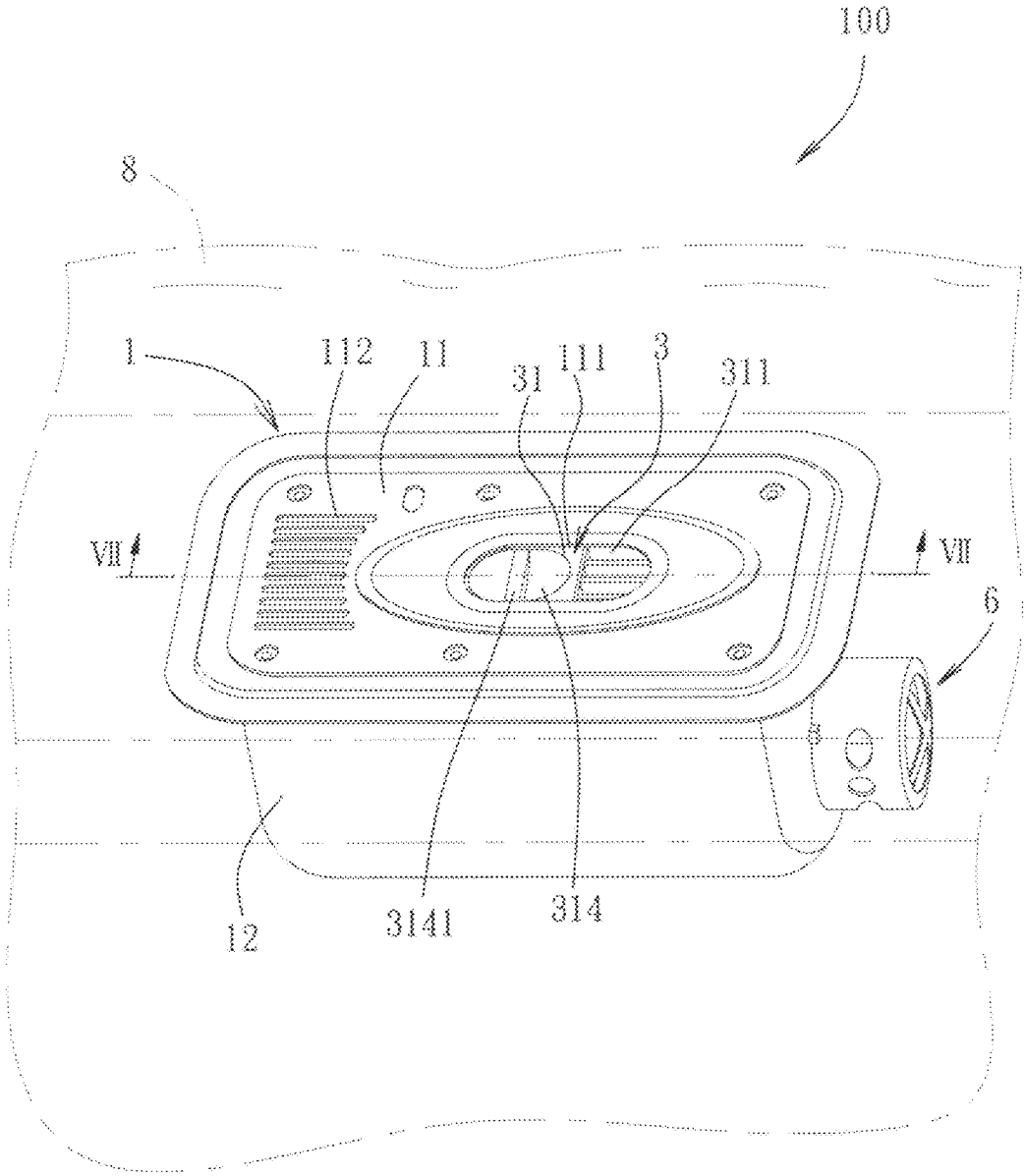
FIG. 2 is a perspective view showing the preferred embodiment when in an inflation mode.
Figure 3:
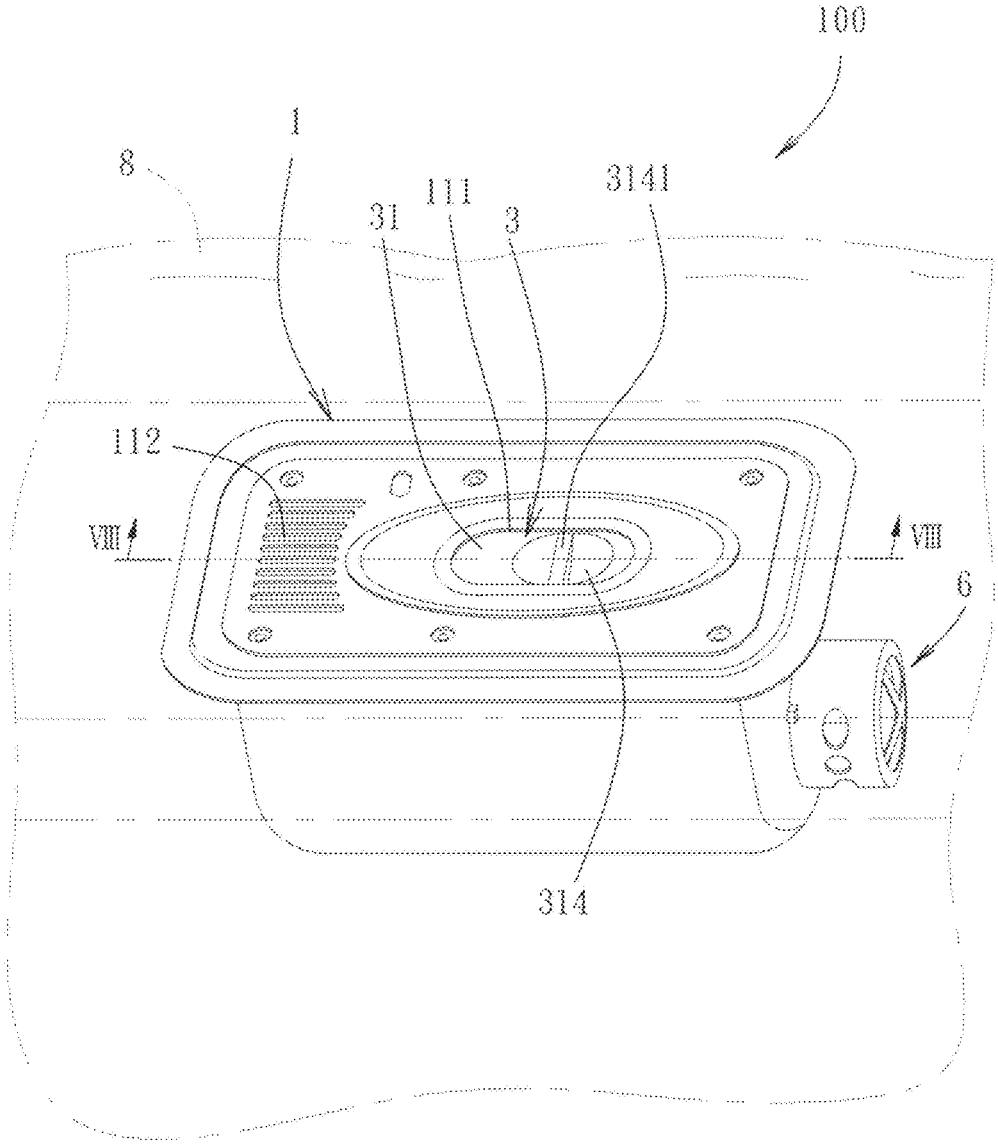
FIG. 3 is a perspective view showing the preferred embodiment when in a deflation mode.

The operating plate 31 is exposed partly from the cap body 11 of the housing 1 via the opening 111, and is formed with a second vent unit 311 that consists of a plurality of slots in this embodiment (see FIG. 2). In this embodiment, the operating plate 31 is mounted on the inner side surface 113 of the cap body 11 of the housing 1, and is engaged movably between the guiding rails 114 of the cap body 11 of the housing 1 such that the sliding member 3 is guided by the guiding rails 114 of the cap body 11 of the housing in the first direction (X) between the inflation position and the deflation position. The operating plate 31 has a concave portion 314 exposed from the cap body 11 of the housing 1 via the opening 111 (see FIG. 1), and is formed with an operating rib 3141 disposed in the concave portion 314, and two pairs of first and second positioning blocks 312, 313. As shown in FIG. 6, each pair of the first and second positioning blocks 312, 313 corresponds to a respective stopping protrusion 115 of the cap body 11 of the housing 1. The first and second positioning blocks 312, 313 of each pair are spaced apart from each other in the first direction (X) such that the respective stopping protrusion 115 of the cap body 11 of the housing 1 is disposed therebetween. When the sliding member 3 is in the inflation position, the first positioning block 312 of each pair abuts against the respective stopping protrusion 115 of the cap body 11 of the housing 1. When the sliding member 3 is in the deflation position, the second positioning block 313 of each pair abuts against the respective stopping protrusion 115 of the cap body 11 of the housing 1.

The partitioning plate 32 is connected to the operating plate 31, and cooperates with the housing 1 and the partition casing 2 to define thereamong a first chamber 71 that is in spatial communication with the air nozzle 6, and a second chamber 72 that is in spatial communication with the first vent unit 112 in the cap body 11 of the housing 1. In this embodiment, the partitioning plate 32 is transverse to the operating plate 31, and has two ends 321 opposite to each other in the second direction (Y) (see FIG. 6) and engaging movably and respectively the positioning grooves 121 in the inner side surface portions of the inner surface of the base body 12 of the housing 1 such that the ends 321 of the partitioning plate 32 are connected movably to the inner surface of the base body 12 of the housing 1. The partitioning plate 32 further has one side 322 interconnecting the ends 321, distal from the cap body 11 of the housing and connected selectively to the second wall 25 of the partition casing 2 when the sliding member 3 is in the inflation position, as shown in FIG. 7, and to the first wall 24 of the partition casing 2 when the sliding member 3 is in deflation position, as shown in FIG. 8.

The air pipe 33 is connected to the operating plate and the partitioning plate 32, is in spatial communication with the second vent unit 311 in the operating plate 31, and has an open end 331. In this embodiment, as shown in FIG. 7, the air pipe 33 has an inverted L-shape, is received in the first chamber 71, and has a first pipe section 332 extending in the first direction (X), is connected to the partitioning plate 32 and the operating plate 31 such that the first pipe section 332 is in spatial communication with the second vent unit 311 in the operating plate 31 and engaged movably between the guiding rails 114 of the cap body 11, and a second pipe section 333 connected to the first pipe section 332, extending in a third direction (Z) transverse to the first and second directions (X, Y) and having the open end 331.

When the sliding member 3 is in the inflation position, as best shown in FIG. 7, the second vent unit 311 in the operating plate 31 is exposed from the cap body 11 of the housing 1 via the opening 111, the air outlet 23 in the partition casing 2 is in spatial communication with the first chamber 71, and the open end 331 of the air pipe 33 is connected to the air inlet 22 in the partition casing 2 such that the air pipe 33 is in spatial communication with the air impeller chamber 21 in the partition casing 2.

Figure 8:
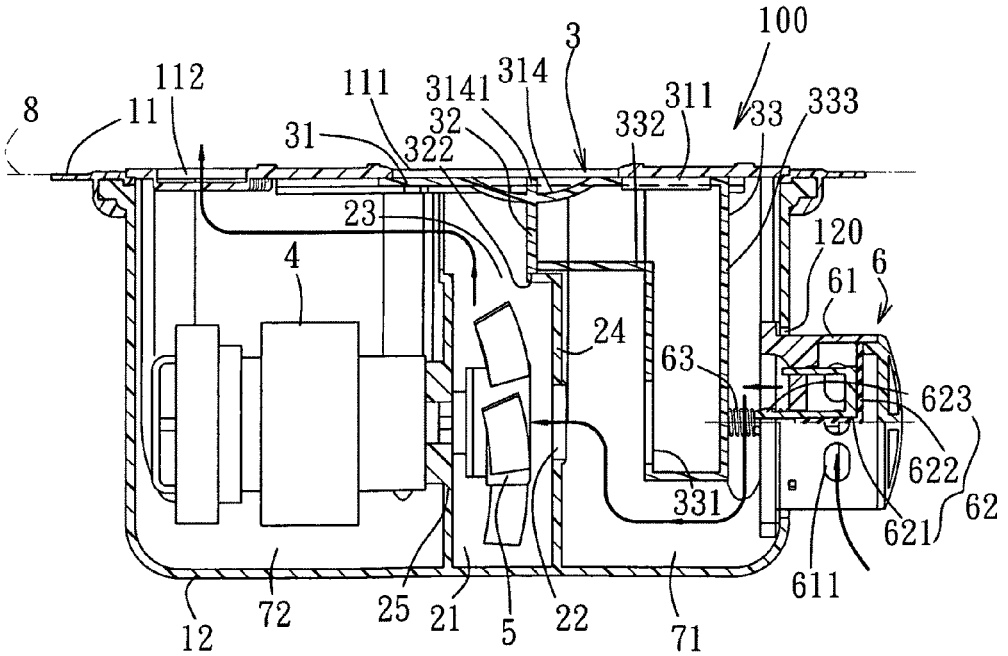
FIG. 8 is a partly schematic sectional view of the preferred embodiment taken along line VIII-VIII in FIG. 3.

When the sliding member 3 is in the inflation position, as best shown in FIG. 8, the second vent unit 311 in the operating plate 31 is covered by the cap body 11 of the housing, the air outlet 23 in the partition casing 2 is in spatial communication with the second chamber 72, and the open end 331 of the air pipe 33 is spaced apart from the air inlet 22 in the partition casing 2 such that the air impeller chamber 21 in the partition casing 2 is in spatial communication with the first chamber 71 via the air inlet 22.

The motor 4 is disposed in the second chamber 72, and has a drive shaft 41 extending through the second wall 25 of the partition casing 2 into the air impeller chamber 21 in the partition casing 2, as shown in FIG. 7.

The air impeller 5 is disposed in the air impeller chamber 21 in the partition casing 2, and is coupled to the drive shaft 41 of the motor 4 such that the air impeller 5 is driven by the motor 4 to rotate, as shown in FIG. 7.

In this embodiment, as shown in FIG. 7, the air nozzle 6 includes a tube body 61 and a control valve 62. The tube body 61 is mounted sealingly in the mounting hole 120 in the base body 12 of the housing 1 and is formed with a plurality of through holes 611. The control valve 62 is disposed in the tube body 61, and is operable to switch between an open state, where the mounting hole 120 in the base body 12 of the housing 1 is unblocked such that the first chamber 71 in the housing 1 is in spatial communication with the through hole 611 in the tube body 61 through the control valve 62, and a closed state, where the mounting hole 120 in the base body 12 of the housing 1 is blocked. The control valve 62 includes a frame 621, a resilient valve plate 622 and a valve stem 623. The frame 621 is mounted movably in the tube body 61 and is movable between an open position, where the control valve 62 is in the open state and where the frame 621 is moved away from the mounting hole 120 in the base body 12 of the housing 1, and a closed position, where the control valve 62 is in the closed state and where the frame 621 is moved toward the mounting hole 120 in the base body 12 of the housing 1. The valve plate 622 is disposed in the tube body 61, and is mounted on the frame 621 for blocking the mounting hole 120 in the base body 12 of the housing 1 when the frame 621 is in the closed position, and for unblocking the mounting hole 120 in the base body 12 of the housing 1 when the frame 621 is in the open position. The valve stem 623 is coupled to the frame 621, is opposite to the valve plate 622, and extends through the mounting hole 120 in the base body 12 of the housing 1. The valve stem 623 is driven by the second pipe section 333 of the air pipe 33 of the sliding member 3 to move when the sliding member 3 is moved to the deflation position such that the frame 621 is moved to the open position in response to movement of the valve stem 623. It is noted that the valve stem 623 is loaded with a biasing member 63, such as a spring, abutting against the second pipe section 333 of the air pipe 33 of the sliding member 3 when the sliding member 3 is moved to the deflation position, thereby biasing the frame 621 toward the open position.

The air pump 100 is operable between an inflating mode, where the sliding member 3 is moved to the inflation position such that air flowing from the outside into the air impeller chamber 21 in the partition casing 2 through the second vent unit 311 in the operating plate 33 of the sliding member 3, through the air pipe 33 of the sliding member 3 and through the air inlet 22 in the partition casing 2 is driven in response to rotation of the air impeller 5 driven by the motor 4 to flow into the inflatable product 8 through the air output 23 in the partition casing 2, through the first chamber 71 and through the air nozzle 6, as indicated by solid-line arrows in FIG. 7, thereby injecting air into the inflatable product 8, and a deflating mode, where the sliding member 3 is moved to the deflating position such that air flowing from the inflatable product 8 into the air impeller chamber 21 in the partition casing 2 through the air nozzle 6, through the first chamber 71 and through the air inlet 22 in the partition casing 2 is driven in response to rotation of the air impeller 5 driven by the motor 4 to flow outside the air pump 100 through the air output 23 in the partition casing 2, through the second chamber 72 and through the first vent unit 112 in the cap body 11 of the housing 1, as indicated by solid-line arrows in FIG. 8, thereby expelling air from the inflatable product 8.

In such a configuration, the air pump 100 of the present invention can be easily operated to inflate and deflate the inflatable product 8 by operating the sliding member 3. The object of the invention is thus met.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. An air pump comprising:

a hollow housing formed with an opening and a first vent unit, and provided with an air nozzle thereon, said air nozzle being adapted to be connected to an inflatable product;

a partition casing disposed fixedly in said housing, cooperating with said housing to define an air impeller chamber therebetween, and formed with an air inlet and an air outlet that are in spatial communication with said air impeller chamber;

a sliding member disposed movably in said housing and operable to move relative to said housing between an inflation position and a deflation position, said sliding member having an operating plate exposed partly from said housing via said opening and formed with a second vent unit, a partitioning plate connected to said operating plate, and an air pipe connected to said operating plate and said partitioning plate, in spatial communication with said second vent unit in said operating plate and having an open end, said partitioning plate of said sliding member cooperating with said housing and said partition casing to define thereamong a first chamber that receives said air pipe and is in spatial communication with said air nozzle, and a second chamber that is in spatial communication with said first vent unit in said housing;

a motor disposed in said second chamber and having a drive shaft extending into said air impeller chamber in said partition casing; and an air impeller disposed in said air impeller chamber in said partition casing, and coupled to said drive shaft of said motor such that said air impeller is driven by said motor to rotate;

wherein, when said sliding member is in the inflation position, said second vent unit in said operating plate of said sliding member is exposed from said housing via said opening, said air outlet in said partition casing is in spatial communication with said first chamber, and said open end of said air pipe of said sliding member is connected to said air inlet in said partition casing such that said air pipe of said sliding member is in spatial communication with said air impeller chamber in said partition casing;

wherein, when said sliding member is in the deflation position, said second vent unit in said operating plate of said sliding member is covered by said housing, said air outlet in said partition casing is in spatial communication with said second chamber, and said open end of said air pipe of said sliding member is spaced apart from said air inlet in said partition casing such that said air impeller chamber in said partition casing is in spatial communication with said first chamber via said air inlet; and wherein said air pump is operable between an inflating mode, where said sliding member is moved to the inflation position such that air flowing from the outside into said air impeller chamber in said partition casing through said second vent unit in said operating plate of said sliding member, through said air pipe of said sliding member and through said air inlet in said partition casing is driven in response to rotation of said air impeller driven by said motor to flow into the inflatable product through said air outlet in said partition casing, through said first chamber and through said air nozzle, thereby injecting air into the inflatable product, and a deflating mode, where said sliding member is moved to the deflation position such that air flowing from the inflatable product into said air impeller chamber in said partition casing through said air nozzle, through said first chamber and through said air inlet in said partition casing is driven in response to rotation of said air impeller driven by said motor to flow outside said air pump through said air outlet in said partition casing, through said second chamber and through said first vent unit in said housing, thereby expelling the air from the inflatable product.

2. The air pump as claimed in claim 1, wherein:

said housing has a base body provided with said air nozzle thereon, and a cap body connected sealingly to said base body and formed with said first vent unit, said cap body having an inner side surface, and two elongate guiding rails formed on said inner side surface, extending in a first direction, and spaced apart from each other in a second direction transverse to the first direction such that said opening is disposed between said guiding rails; and said operating plate of said sliding member is engaged movably between said guiding rails of said cap body of said housing such that said sliding member is guided by said guiding rails of said cap body of said housing to move in the first direction between the inflation position and the deflation position.

3. The air pump as claimed in claim 2, wherein:

said cap body of said housing is formed with a stopping protrusion extending from one of said guiding rails toward the other one of said guiding rails; and said operating plate of said sliding member is formed with first and second positioning blocks spaced apart from each other in the first direction such that said stopping protrusion of said cap body of said housing is disposed between said first and second positioning blocks, said first positioning block abutting against said stopping protrusion of said cap body of said housing when said sliding member is in the inflation position, said second positioning block abutting against said stopping protrusion of said cap body of said housing when said sliding member is in the deflation position.

4. The air pump as claimed in claim 2, wherein:

said partition casing includes opposite first and second walls spaced apart from each other in the first direction and connected to an inner surface of said base body of said housing, and a third wall spaced apart from said cap body of said housing, connected among said first and second walls and said inner surface of said base body of said housing, and formed with said air outlet, said first wall being formed with said air inlet, said second wall permitting extension of said drive shaft of said motor therethrough; and said partitioning plate of said sliding member is transverse to said operating plate, has two ends opposite to each other in the second direction and connected movably to said inner surface of said base body of said housing, and one side interconnecting said ends, distal from said cap body of said housing and connected selectively to said second wall of said partition casing when said sliding member is in the inflation position, and to said first wall of said partition casing when said sliding member is in the deflation position.

5. The air pump as claimed in claim 4, wherein said inner surface of said base body of said housing is formed with two positioning grooves opposite to each other in the second direction, and engaging movably and respectively said ends of said partition plate of said sliding member.

6. The air pump as claimed in claim 2, wherein said air pipe of said sliding member has a first pipe section extending in the first direction, connected to said partitioning plate and said operating plate such that said first pipe section is in spatial communication with said second vent unit in said operating plate and engaged movably between said guiding rails of said cap body, and a second pipe section connected to said first pipe section, extending in a third direction transverse to the first and second directions and having said open end.

7. The air pump as claimed in claim 1, wherein said operating plate of said sliding member has a concave portion exposed from said housing via said opening.

8. The air pump as claimed in claim 1, wherein:

said housing is formed with a mounting hole; and said air nozzle includes a tube body mounted sealingly in said mounting hole in said housing and formed with a plurality of through holes, and a control valve disposed in said tube body and operable to switch between an open state, where said mounting hole in said housing is unblocked such that said first chamber in said housing is in spatial communication with said through holes in said tube body through said control valve, and a closed state, where said mounting hole in said housing is blocked.

9. The air pump as claimed in claim 8, wherein said control valve of said air nozzle includes:

a frame mounted movably in said tube body and movable between an open position, where said control valve is in the open state and where said frame is moved away from said mounting hole in said housing, and a closed position, where said control valve is in the closed state and where said frame is moved toward said mounting hole in said housing;

a resilient valve plate disposed in said tube body and mounted on said frame for blocking said mounting hole in said housing when said frame is in the closed position, and for unblocking said mounting hole in said housing when said frame is in the open position; and a valve stem coupled to said frame, opposite to said valve plate and extending through said mounting hole in said housing, said valve stem being driven by said air pipe of said sliding member to move when said sliding member is moved to the deflation position such that said frame is moved to the open position in response to movement of said valve stem.

10. The air pump as claimed in claim 9, wherein said valve stem is loaded with a biasing member abutting against said air pipe of said sliding member when said sliding member is moved to the deflation position, thereby biasing said frame toward the open position.

* * * * *